US007621402B2

(12) United States Patent
Sandow

(10) Patent No.: US 7,621,402 B2
(45) Date of Patent: Nov. 24, 2009

(54) PRINT MEDIA DISPLAY PACKAGE WITH COMBINED MERCHANDISE DISPLAY

(75) Inventor: Adam I. Sandow, Boca Raton, FL (US)

(73) Assignee: Sandow Media, LLC, Boca Raton, FL (US)

( * ) Notice: Subject to any disclaimer, the term of this patent is extended or adjusted under 35 U.S.C. 154(b) by 342 days.

(21) Appl. No.: 11/618,269

(22) Filed: Dec. 29, 2006

(65) Prior Publication Data

US 2008/0156675 A1 Jul. 3, 2008

(51) Int. Cl.
*B65D 69/00* (2006.01)
*B65D 71/00* (2006.01)

(52) U.S. Cl. ..... 206/581; 206/232

(58) Field of Classification Search ..... 206/241, 206/775, 776, 779–782, 771, 736, 584, 461, 206/424, 232, 216, 730, 732, 734, 735, 581, 206/499, 463, 804; 40/312, 307, 306; 229/162.1–162.4, 229/162.6–162.7
See application file for complete search history.

(56) References Cited

U.S. PATENT DOCUMENTS 2,728,450 A * 12/1955 Haire ..... 206/459.5
3,301,621 A * 1/1967 Stephenson ..... 312/234
4,290,524 A * 9/1981 Azar ..... 206/232
4,369,882 A * 1/1983 Schluger ..... 206/232
4,669,610 A * 6/1987 Lindsey et al. ..... 206/320
4,711,348 A * 12/1987 Schluger ..... 206/45.29
5,022,522 A * 6/1991 Kennedy ..... 206/232
5,209,349 A * 5/1993 Porter et al. ..... 206/232
5,716,075 A * 2/1998 Evert, Jr. ..... 281/31
6,112,900 A * 9/2000 Adkins, Jr. ..... 206/570
7,264,123 B2 * 9/2007 Reed ..... 206/765
2003/0066766 A1 * 4/2003 Lechanoine et al. ..... 206/216
2004/0089579 A1 * 5/2004 Berliner et al. ..... 206/499
2005/0247597 A1 * 11/2005 Reed ..... 206/775

* cited by examiner

*Primary Examiner*—Ehud Gartenberg
*Assistant Examiner*—Kaushikkumar Desai
(74) *Attorney, Agent, or Firm*—Novak Druce + Quigg; J. Rodman Steele, Jr.; Gregory M. Lefkowitz

(57) ABSTRACT

A media package configured to contain a piece of print media such that a cover of the piece of print media may be displayed without opening the removable lid and to contain one or more product display portals enabling a product other than the print media to be contained in the box and be viewable outside of the box without opening the box. Thus, the media package enables print media and other products, such as those that appeal to readers of the print media, to be marketed together with the print media to increase sales of the print media. The products may be, but are not limited to, lotions, body cleansers, soaps, makeup, and sun care products.

17 Claims, 2 Drawing Sheets

PRINT MEDIA DISPLAY PACKAGE WITH COMBINED MERCHANDISE DISPLAY

FIELD OF THE INVENTION

This invention is directed generally to print media, and more particularly to packages for protecting print media, such as magazines.

BACKGROUND

The periodical print media market is typically formed of monthly, quarterly, semiannual and annual magazines directed to a wide variety of topics. The periodical print media market is very competitive, which often causes publishers to seek ways to distinguish a publication from the competition periodicals. In the past, periodicals have been wrapped in plastic or placed in envelops to reduce the likelihood that the periodicals will be damaged in the mail or on the newsstand. The plastic has typically been thin and of limited success.

Publishers have also attempted to increase income and to differentiate a periodical by including samples. For instance, samples, such as leaflets with cologne or perfume on the leaflets, have been included in periodicals to increase advertisement revenues. However, these paper leaflets have been included within the magazine and have not visible when viewing the cover. Thus, the potential impact of the samples has been limited to the impression on a reader once the reader has purchased the periodical, opened the periodical and turned to the page of the sample. While some of these marketing tactics may have been successful to a limited degree, there remains a need for enhanced marketing devices for print media.

SUMMARY OF THE INVENTION

This invention relates to a media package configured to contain both a piece of print media and one or more products that may be cross-marketed to a reader of the print media. For instance, in one embodiment, the media package may be referred to as a beauty box with a magazine directed to women's apparel, cosmetics, and other related items and may include human body care products such as, but not limited to, lotions, body cleansers, soaps, makeup, and sun care products. The media package may be configured to display both the print media and the products to a potential purchaser of the media package without the media package having to be opened Thus, the media package may combine one or more pieces of print media with one or more products that would relate to the same group of potential purchaser for enhanced marketability. The print media may be, but is not limited to, a magazine, such as a monthly, quarterly, semiannual, annual, or other periodic magazine, a single issue magazine or other print media. The product may be, but is not limited to being, a human body care product such as lotions, body cleansers, soaps, makeup, and sun care products.

The media package may be formed from a box configured to contain a piece of print media such that a cover of the piece of print media may be displayed without opening the box. The box may include at least one product display portal enabling a product other than the print media to be contained in the box and be viewable outside of the box without opening the box. In one embodiment, the box may include a plurality of product display portals. The box may be formed from a bottom and four sides extending generally orthogonally from the bottom and generally orthogonally to each other to form an open ended box. The four sides and bottom may be sized such that a cavity formed in the box is larger than the piece of print media. A transparent lid may be configured to be attached to the box to cover the cavity yet allow the print media to be viewable through the transparent lid. The bottom may reside in a single plane and may include the product display portal protruding out of the single plane from the bottom away from the cavity. The product display portal may be formed from a transparent material enabling the product contained in the product display portal to be viewable through the product display portal. The product display portal may form a cavity having a shape that resembles a shape of the product displayed in the product display portal. The cavity may enable the product to be displayed out of the plane of the bottom.

An advantage of this invention is that a piece of print media, such as a magazine, may be cross-marketed together with products that may interest a likely prospective buyer of the print media to increase the potential for sales of the print media.

Another advantage of this invention is that the print media may be used to increase the knowledge of and use of the attached product or vice versa.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 2:
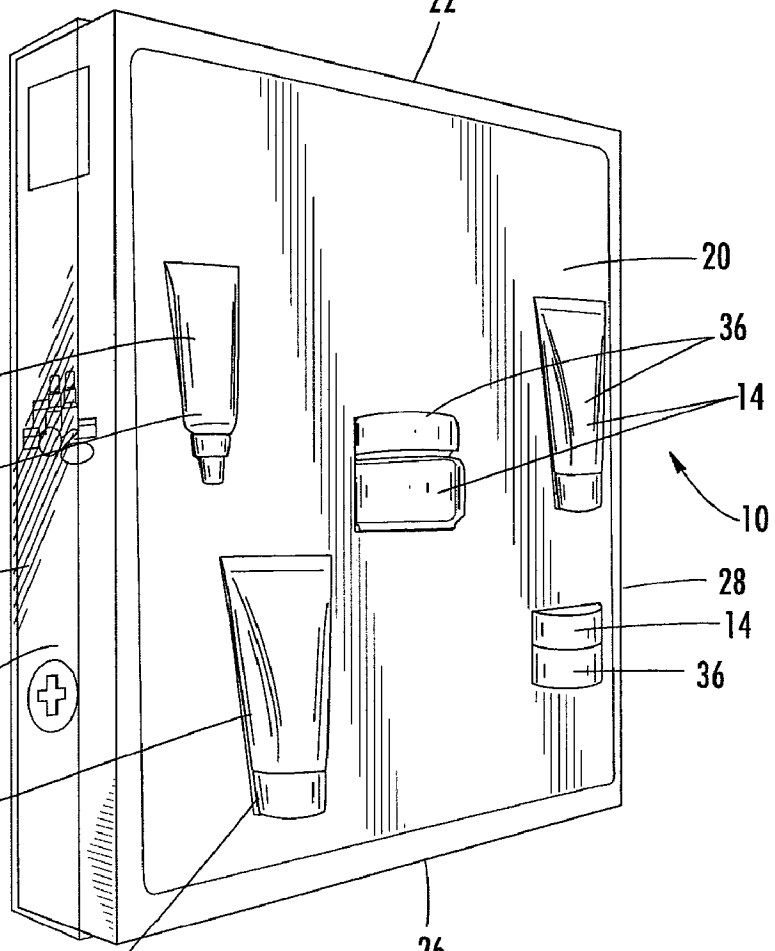
FIG. 2 is a rear perspective view of the media package displaying aspects of this invention.
Figure 1:
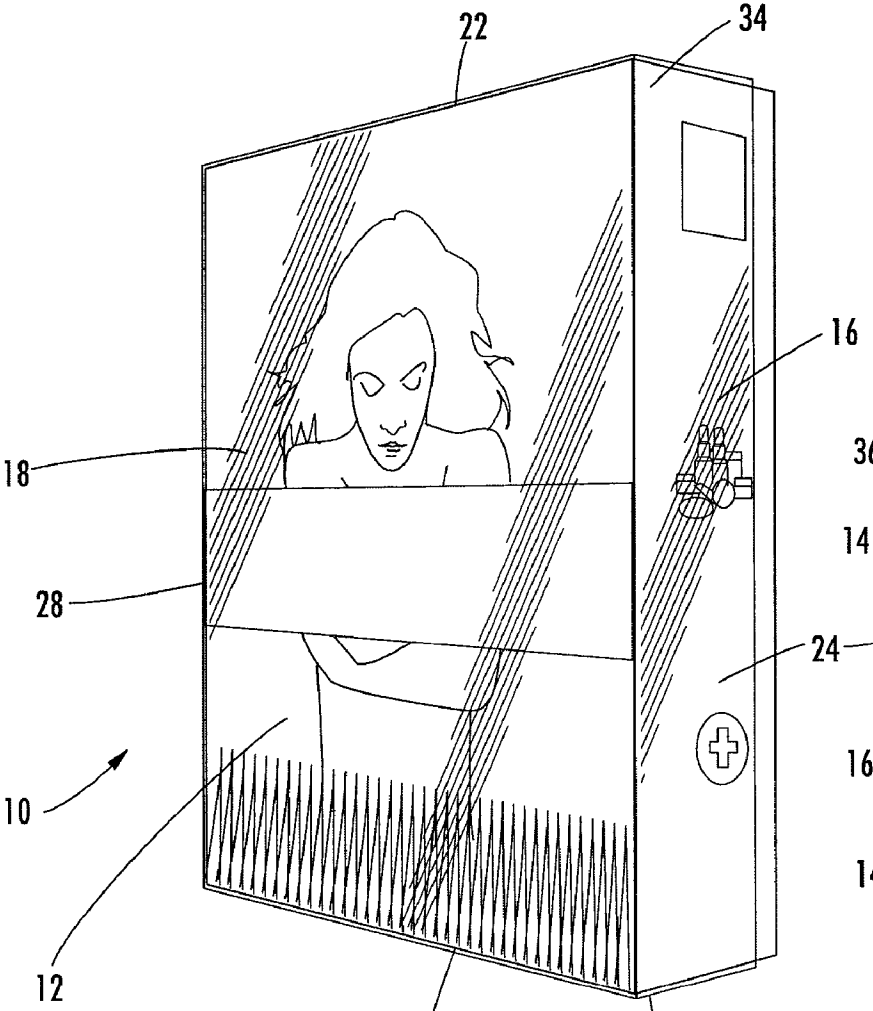
FIG. 1 is a front perspective view of a media package displaying aspects of this invention.
Figure 3:
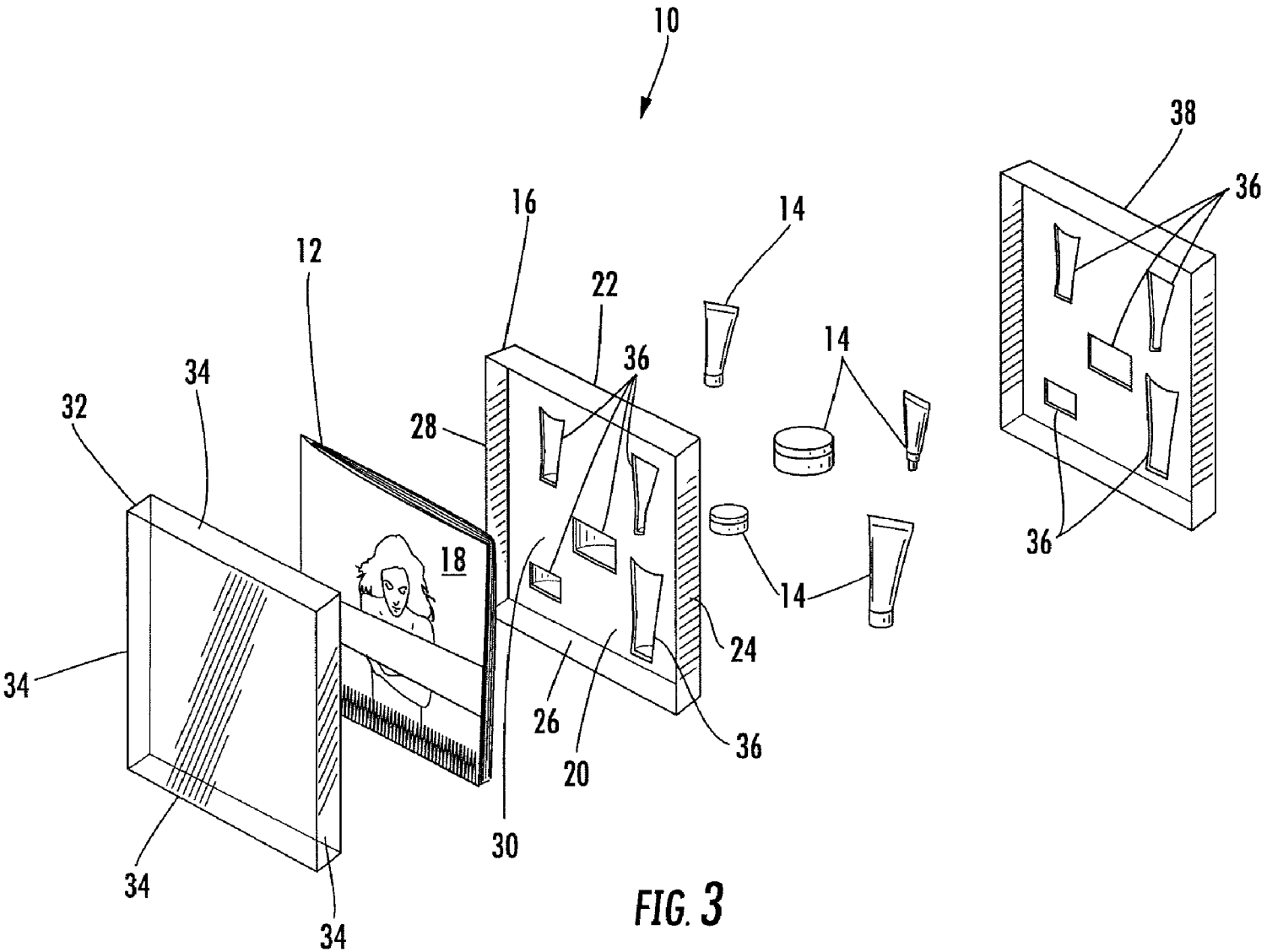
FIG. 3 is an exploded perspective view of the media package.

As shown in FIGS. 1-3, this invention is directed to a media package 10 configured to contain both a piece of print media 12 and one or more products 14 that may be cross-marketed to a reader of the print media 12. The media package 10 may be configured to display both the print media 12 and the products 14 to a potential purchaser of the media package 10 without the media package 10 having to be opened. Thus, the media package 10 may combine one or more pieces of print media 12 with one or more products that would relate to the same group of potential purchaser for enhanced marketability. The print media 12 may be, but is not limited to, a magazine, such as a monthly, quarterly, semiannual, annual, or other periodic magazine, a single issue magazine or other print media. The product 14 may be, but is not limited to being, a human body care product such as lotions, body cleansers, soaps, makeup, sun care products or other products. The products 14 may be sample size or other sized items.

As shown in FIGS. 1-3, the media package 10 may be formed from a box 16 configured to contain a piece of print media 12 such that a cover 18 of the piece of print media 12 may be displayed without opening the box 16. The box 16 may be formed from materials such as, but not limited to, cardboard, one or more plastics, and other appropriate materials. In one embodiment, the box 16 may be formed as an open ended box from a bottom 20 and four sides 22, 24, 26 and 28 extending generally orthogonally from the bottom 20 and generally orthogonally to each other to form an open ended box 16. The four sides 22, 24, 26 and 28 and the bottom 20 are sized such that a cavity 30 formed in the box 16 is larger than the piece of print media 12 so that the print media 12 may be contained in the box 16. In one embodiment, the four sides 22, 24, 26 and 28 may be positioned at a distance from each other that is slightly larger than a height and width of the print media 12 so that the print media 12 may fit within the cavity 30 and be supported by the sides 22, 24, 26 and 28 forming the box 16. The box 16 may have other configurations in other embodiments.

The box 16 may include a removable lid 32 configured to cover the cavity 30 formed in the box 16. The removable lid 32 may be formed from a transparent material, such as a plastic, or other appropriate material, enabling the cover 18 of the print media 12 to be viewed through the removable lid 32. The removable lid 32 may include sidewalls 34 extending from the removable lid 32 similar to the sides 22, 24, 26 and 28 so that the removable lid 32 may be attached to the box 16.

The media package 10 may also include one or more product display portals 36 enabling a product other than the print media 12 to be contained in the box 16 and be viewable from outside of the box 16 without opening the box 16. For instance, as shown in FIG. 2, the media package 10 may include a plurality of product display portals 36 in the bottom 20 of the box 16. The product display portals 36 may include openings in the bottom 20. The bottom 20 may reside in a single plane and the product display portals 36 may protrude from the plane away from the cavity 30. In at least one embodiment, the product display portals 36 may be formed from a transparent material, such as a plastic, or other appropriate material, enabling the products 14 to be viewed through the product display portals. The product display portals 36 may be sized smaller than the bottom 20. In one embodiment, the product display portals 36 may be have a shape that mimics the shape of the product 14 contained in the product display portal 36 to support the product 14. The bottom 20 may also include written descriptions of the products 14 that are proximate to the product display portals 36.

In one embodiment, the media package 10 may be referred to as a beauty box 16 configured to contain a human body care product selected from the group consisting of lotions, body cleansers, soaps, makeup, and sun care products. the products 14 may be contained in jars, rigid bottles, squeezable containers, and other devices. The print media 12 may be a magazine such as a magazine directed to women's apparel, cosmetics, and other related items. The beauty box 16 may include advertisements, tips, product descriptions and other such items on the sides 22, 24, 26 and 28. In one embodiment, the product display portals 36 may be contained in a product display lid 38. The product display lid 38 may resemble the removable lid 32 yet include the product display portals 36. The product display lid 38 may be formed from a transparent material, such as plastic, or other appropriate material.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A media package, comprising:

a box configured to contain a piece of print media such that a cover of the piece of print media may be displayed without opening the box, wherein the box is formed from a bottom and four sides extending generally orthogonally from the bottom and generally orthogonally to each other to form an open ended box, wherein the four sides and bottom form a cavity, wherein said bottom comprises at least one opening configured to receive a product other than a piece of print media; and a product display lid comprising at least one product display portal, said product display lid configured to be attached to the box to cover the bottom yet allow a product other than a piece of print media disposed in said at least one opening to be viewable through the at least one product display portal, further comprising a transparent lid configured to be attached to the box to cover the cavity yet allow a piece of print media to be viewable through the transparent lid.

2. The media package of claim 1, wherein the bottom resides in a single plane.

3. The media package of claim 2, wherein the at least one product display portal is formed from a transparent material and configured to enable a product contained in the at least one opening to be viewable through the at least one product display portal.

4. The media package of claim 3, wherein at least one product display portal comprises a plurality of product display portals protruding from the product display lid.

5. The media package of claim 1, wherein the at least one opening has a shape that resembles a shape of a product to be displayed in the at least one opening.

6. The media package of claim 1, wherein the piece of print media the box configured to contain is a magazine.

7. The media package of claim 1, wherein the product other than a piece of print media that the at least one opening is configured to contain is a human body care product selected from the group consisting of lotions, body cleansers, soaps, makeup, and sun care products.

8. A media package, comprising:

a box including a removable lid configured to contain a piece of print media such that a piece of print media may be displayed without opening the removable lid;

wherein the box includes at least one opening configured to enable a product other than print media to be contained in the box and be viewable outside of the box without opening the box; and wherein the box is formed from a bottom and four sides extending generally orthogonally from the bottom and generally orthogonally to each other to form an open ended box, wherein the four sides and bottom are sized such that a cavity formed in the box is larger than a piece of print media yet supports the print media in the box, and a product display lid comprising at least one product display portal, said product display lid configured to be attached to the box to cover the bottom yet allow a product other than a piece of print media disposed in said at least one opening to be viewable through the at least one product display portal, wherein the removable lid is formed from a transparent material configured to be attached to the box to cover the cavity yet allow a print media to be viewable through the transparent removable lid.

9. The media package of claim 8, wherein the bottom resides in a single plane.

10. The media package of claim 8, wherein the at least one product display portal is formed from a transparent material and configured to enable a product other than print media contained in the at least one opening to be viewable through the at least one product display portal.

11. The media package of claim 8, wherein at least one product display portal comprises a plurality of product display portals protruding from the product display lid.

12. The media package of claim 8, wherein the at least one product display portal is configured to resemble a shape of a product other than a piece of print media.

13. The media package of claim 8, wherein the box is configured to contain a magazine.

14. The media package of claim 8, wherein the at least one opening is configured to receive a human body care product selected from the group consisting of lotions, body cleansers, soaps, makeup, and sun care products.

15. A media package, comprising:

a box, a magazine, and at least one product other than a magazine, said box including a transparent removable lid configured to contain a magazine such that a cover of the magazine may be viewable through the transparent removable lid without opening the removable lid;

wherein the box includes at least one opening enabling the product other than the magazine to be contained in the box and be viewable outside of the box without opening the box; and wherein the box is formed from a bottom and four sides extending generally orthogonally from the bottom and generally orthogonally to each other to form an open ended box, wherein the four sides and bottom are sized such that a cavity formed in the box is larger than the magazine yet supports the magazine in the box, and a product display lid comprising at least one product display portal, said product display lid configured to be attached to the box to cover the bottom yet allow the product other than a magazine disposed in said at least one opening to be viewable through the at least one product display portal.

16. The media package of claim 15, wherein the bottom resides in a single plane and the product display lid is transparent, and wherein the at least one opening and the at least one product display portal are aligned such that the product other than a magazine contained in the at least one opening is viewable through the at least one product display portal.

17. The media package of claim 15, wherein the at least one opening is configured to contain human body care product selected from the group consisting of lotions, body cleansers, soaps, makeup, and sun care products.

* * * * *